US006809697B2

(12) United States Patent
Churng-Jou et al.

(10) Patent No.: US 6,809,697 B2
(45) Date of Patent: Oct. 26, 2004

(54) DUAL-FREQUENCY BROADBAND ANTENNAS

(75) Inventors: Tsai Churng-Jou, Tainan Hsien (TW); Chong Ming-Hsiun, Taipei (TW)

(73) Assignee: Antenniques Corp., Taipei Hsien (TW)

( * ) Notice: Subject to any disclaimer, the term of this patent is extended or adjusted under 35 U.S.C. 154(b) by 143 days.

(21) Appl. No.: 10/313,071

(22) Filed: Dec. 6, 2002

(65) Prior Publication Data

US 2004/0108962 A1 Jun. 10, 2004

(51) Int. Cl.[7] ..... H01Q 9/16
(52) U.S. Cl. ..... 343/792; 343/793; 343/790
(58) Field of Search ..... 343/792, 790, 343/791, 793, 807, 773, 774; H01Q 9/16

(56) References Cited

U.S. PATENT DOCUMENTS 3,829,863 A * 8/1974 Lipsky ..... 343/773
5,892,485 A * 4/1999 Glabe et al. ..... 343/789
6,483,471 B1 * 11/2002 Petros ..... 343/725
6,642,902 B2 * 11/2003 Gustafson ..... 343/791

* cited by examiner

*Primary Examiner*—Hoanganh Le

(57) ABSTRACT

A dual-frequency broadband antenna mainly comprises a dipole antenna set and an inductive shield, in which a positive and a negative pole are substantially two cup-like tubular hollow poles spaced out from a distance apart equal to ¼λ of a high frequency band approximately; and the inductive shield is a tube made of an insulating material, having a open end. The dipole antenna set is assembled in a cavity of the inductive shield without contacting the inner rim of the latter.

4 Claims, 5 Drawing Sheets

H-Plane
2.45GHz:_____ · 5.25GHz:.....

E-Plane
2.45GHz:_____ · 5.25GHz:.....

DUAL-FREQUENCY BROADBAND ANTENNAS

FIELD OF THE INVENTION

The present invention relates to an antenna, and more specifically to an dual-frequency broadband antenna.

BACKGROUND OF THE INVENTION

A generic half-wavelength (½λ) antenna is a so-called dipole antenna as indicated in FIG. 1, in which the distance between a positive and a negative pole of the antenna is theoretically arranged as shorter as possible to thereby obtain a better radiating and receiving effect.

In a conventional copper-duct dipole antenna structure (40) shown in FIG. 2, a coaxial cable (41) is penetratingly laid in a hollow copper duct (42) of ¼ wavelength (λ) long approximately, in which a conductive woven layer (411) of the coaxial cable (41) is connected to the hollow copper duct (42) to form a negative pole (–) while a bare core (410) in ¼λ long approximately would serve for a positive pole (+). The effective bandwidth of such a conventional dipole antenna (40) is about 5.0~10.0% of a frequency band (that is, ratio of bandwidth to center frequency), 100~240 MHz for the frequency band of 2.4~2.5 GHz, for example. Unfortunately, however, the structure of this conventional dipole antenna (40) can be applied for a single-frequency band antenna only, not yet available for a dual-frequency band antenna.

To improve the structure of the mentioned dipole antenna to fit for a dual-frequency band antenna and widen the bandwidth thereof would provide an alternative for more effective radio communication. In this consideration, the inventor has endeavored to provide a novel dual-frequency broadband antenna in a proper length for high-performance signal radiation and reception.

SUMMARY OF THE INVENTION

The primary objective of this invention is to provide a dipole antenna set for signal radiation and reception in a low-frequency band, which is supposed to bring about the resonance vibration in a high-frequency band by adjusting the interval between a positive and a negative pole of the antenna to ¼λ of the high frequency band approximately.

Another objective of this invention is to provide a structure of dual-frequency broadband antenna that can broaden the bandwidth of resonance vibration to about 25% by means of an inductive shield covered on the dipole antenna set.

Yet another objective of this invention is to provide a structure of dual-frequency broadband antenna, in which the interval between a positive and a negative pole of the antenna is adjusted to ¼λ of the high frequency band such that the increment of the antenna under the function of dual-frequency band is limited shorter than ¼λ of the high frequency band to present a decent appearance thereof.

In order to achieve the mentioned objectives, the structure of dual-frequency broadband antenna of this invention mainly comprises a dipole antenna set and an inductive shield, in which a positive and a negative pole are substantially two cup-like poles spaced out from a distance apart equal to ¼λ of the high frequency band approximately; the inductive shield is a tube made of an insulating material, having a open end. The dipole antenna set is assembled in a cavity of the inductive shield without contacting the inner rim of the latter.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
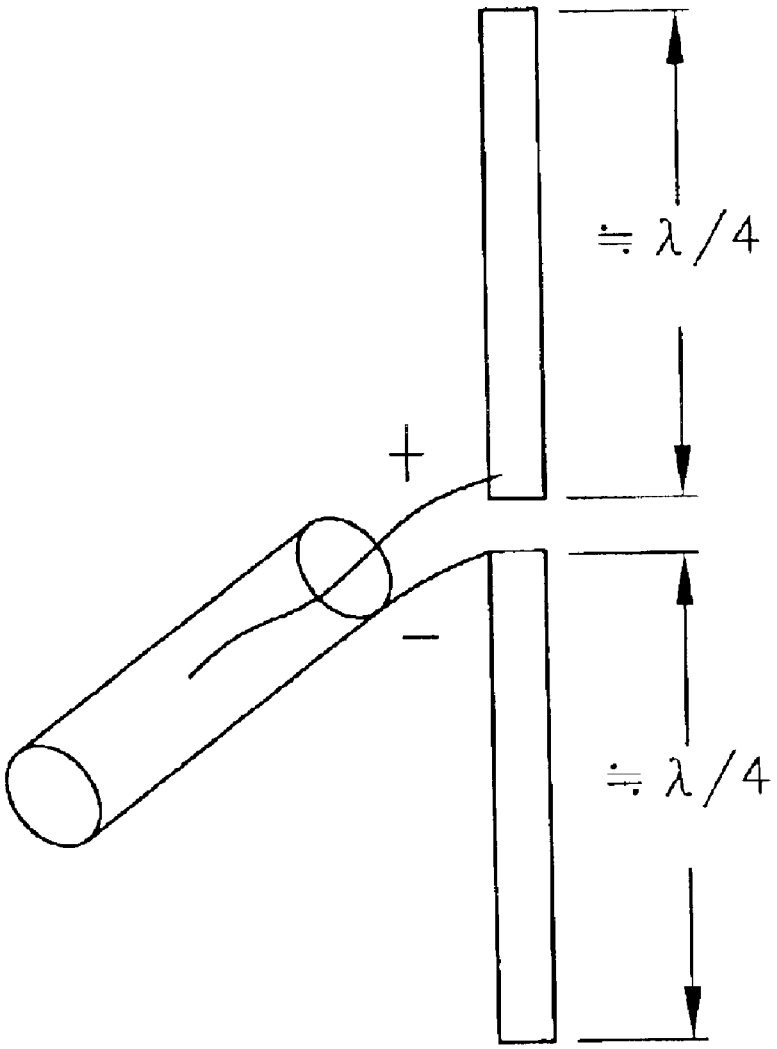
FIG. 1 (PRIOR ART)
FIG. 1 is a schematic view showing the basic structure of a dipole antenna.
Figure 2:
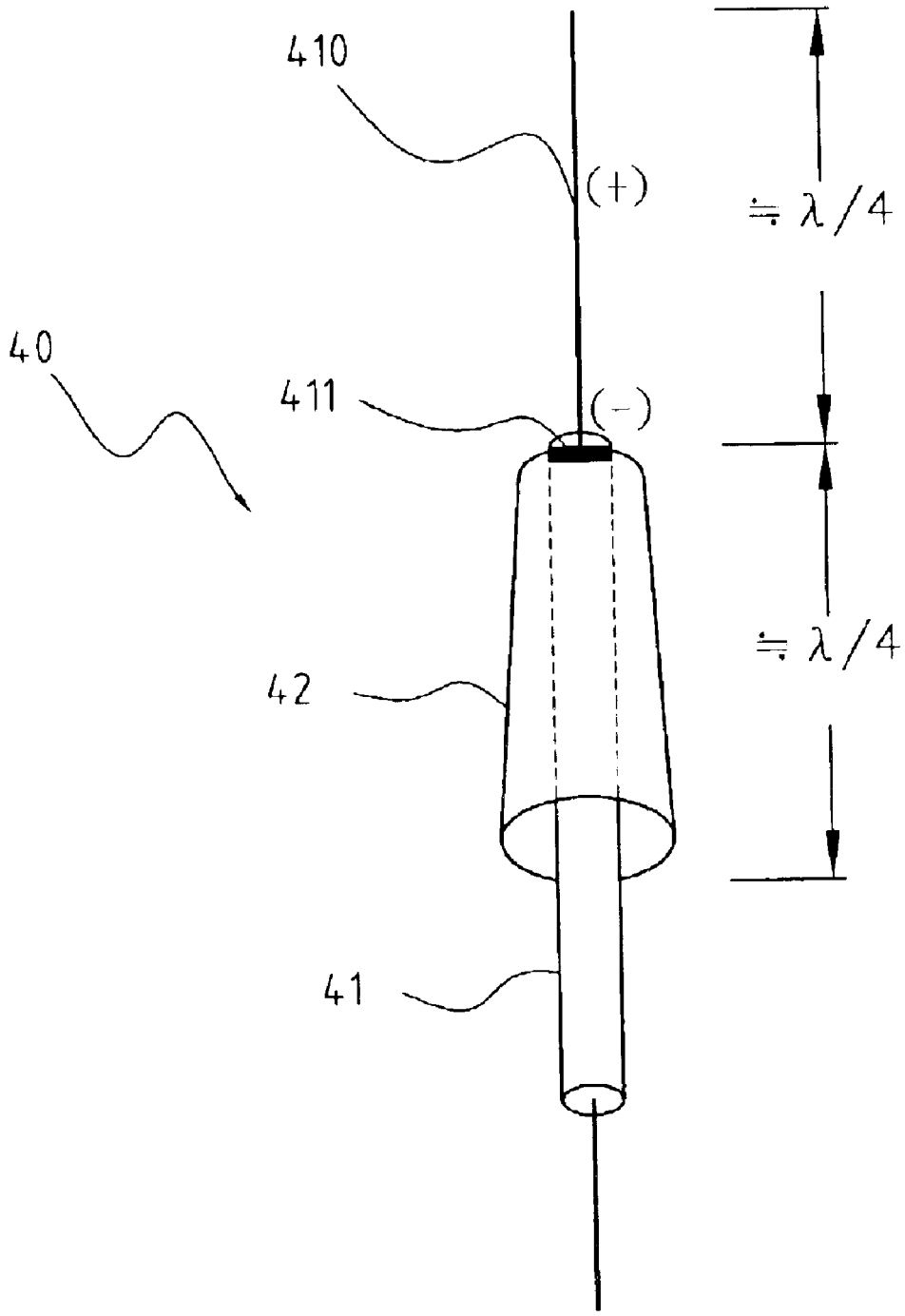
FIG. 2 (PRIOR ART)
FIG. 2 is a schematic view showing the structure of a conventional dipole antenna.
Figure 3:
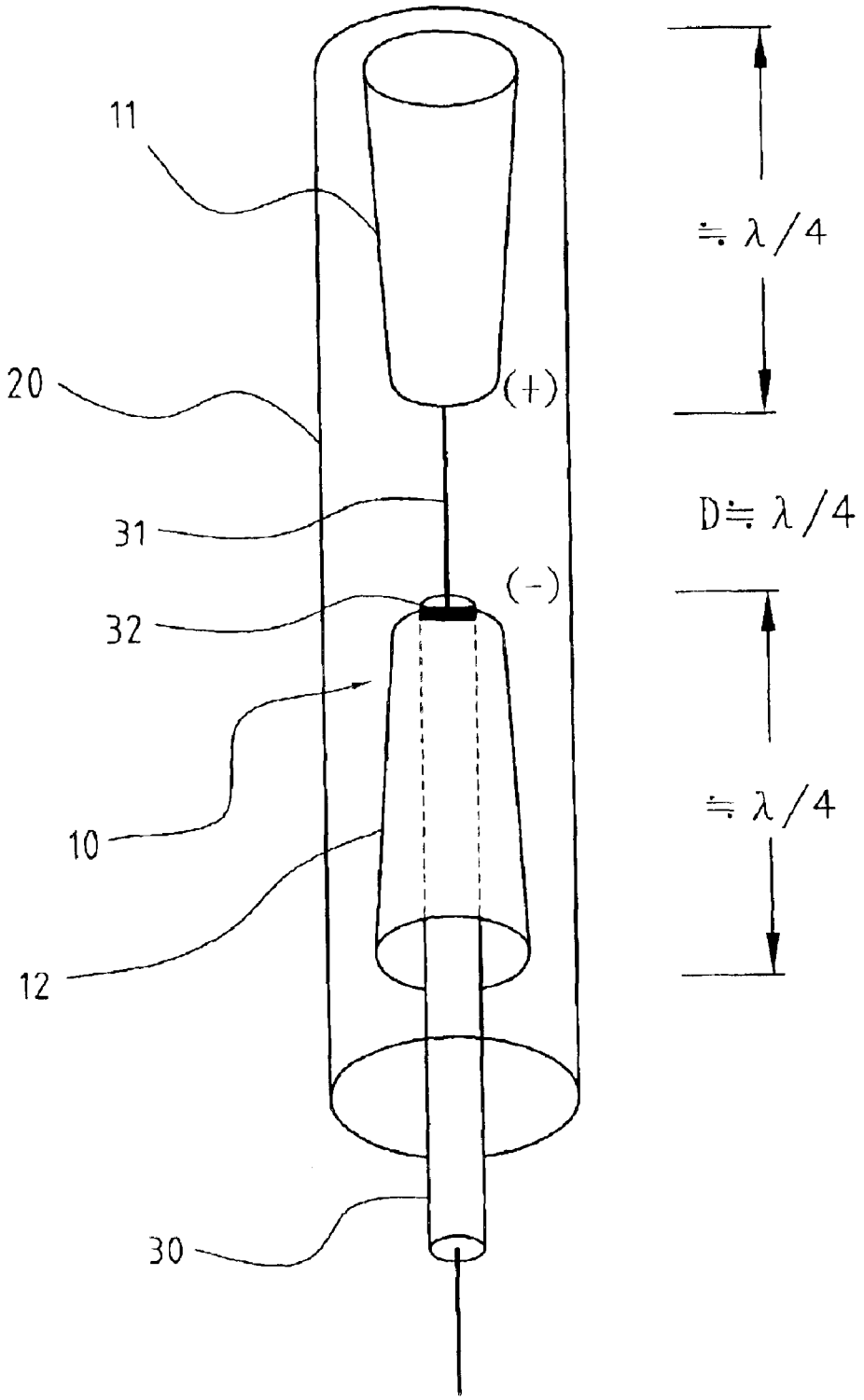
FIG. 3 is a schematic view of the structure of this invention.

As shown in FIG. 3, the structure of a dual-frequency broadband antenna of this invention mainly comprises a dipole antenna set (10) and an inductive shield (20). The dipole antenna set (10) is further comprised of a positive and a negative cup-like tubular hollow pole (11, 12) made of a conductive material and inter-spaced by a distance D approximately equal to ¼λ of a high-frequency band while the length of those two cup-like poles (11, 12) are the same equal to ¼λ of a low-frequency band. Moreover, each close end of those two poles (11, 12) is directed inwardly while each open end outwardly, and a coaxial cable (30) penetrates through the cup-like pole (12) and a conductive woven layer (32) of the coaxial cable (30) is connected to the close end of the cup-like pole (12) to form a negative pole (–) of low-frequency band. A core (31) of the coaxial cable (30) is isolated from that negative pole (–) and extended to connect with a close end of the cup-like pole (11) to form a positive pole (+) of low-frequency band, in which the length of the extended end of the core (31) is substantially equal to the distance D between those two cup-like poles (11, 12). In this embodiment, both the cup-like poles (11, 12) are hollow copper tubes.

The inductive shield (20) is a tube having an open end, and is made of an insulating material for covering the dipole antenna set (10). In the embodiment of this invention, the insulating material adapted for the inductive shield (20) is either plastics or Teflon.

The hollow poles (11, 12) of the dipole antenna set (10) will generate resonance vibration at a low-frequency band to thereby create resonance vibration at a high-frequency band and achieve a dual-frequency radiation and reception effect as well as an enlargement of effective bandwidth of high/low frequency bands by means of the inductive shield (20).

For example, in a dual-frequency band antenna specimen of IEEE802.11A+B according to the antenna structure of this invention, the 802.11B can reach the frequency band up to 2.4~2.5 GHz while the 802.11A as high as 4.9~5.85 GHz to show its outstanding function for radiating and receiving signals of dual-frequency bands economically.

Figure 4:
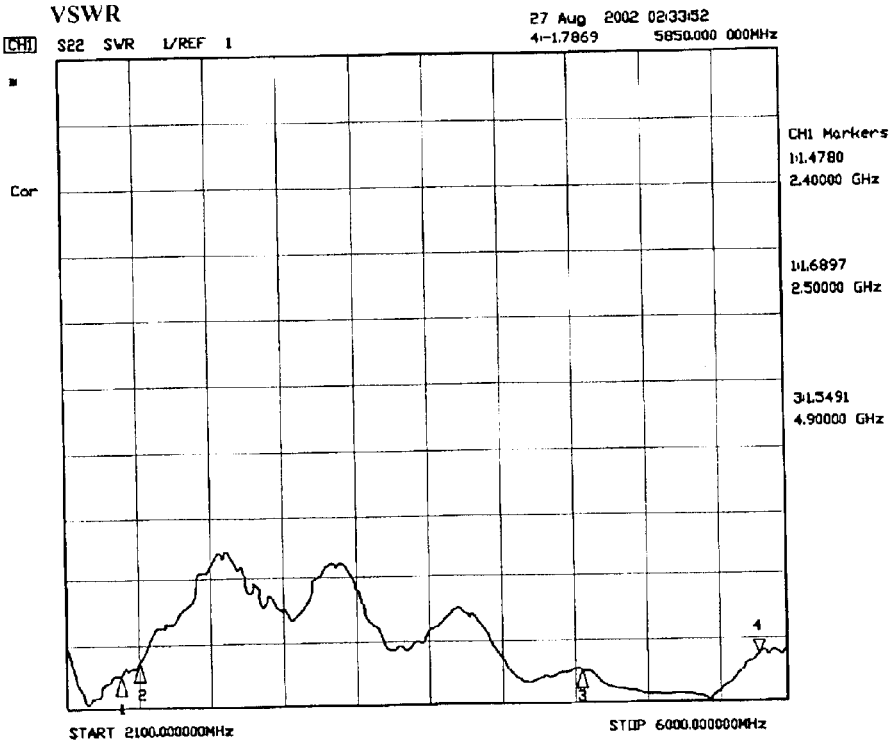
FIG. 4 shows the VSWR of an embodiment of this invention.
Figure 5:
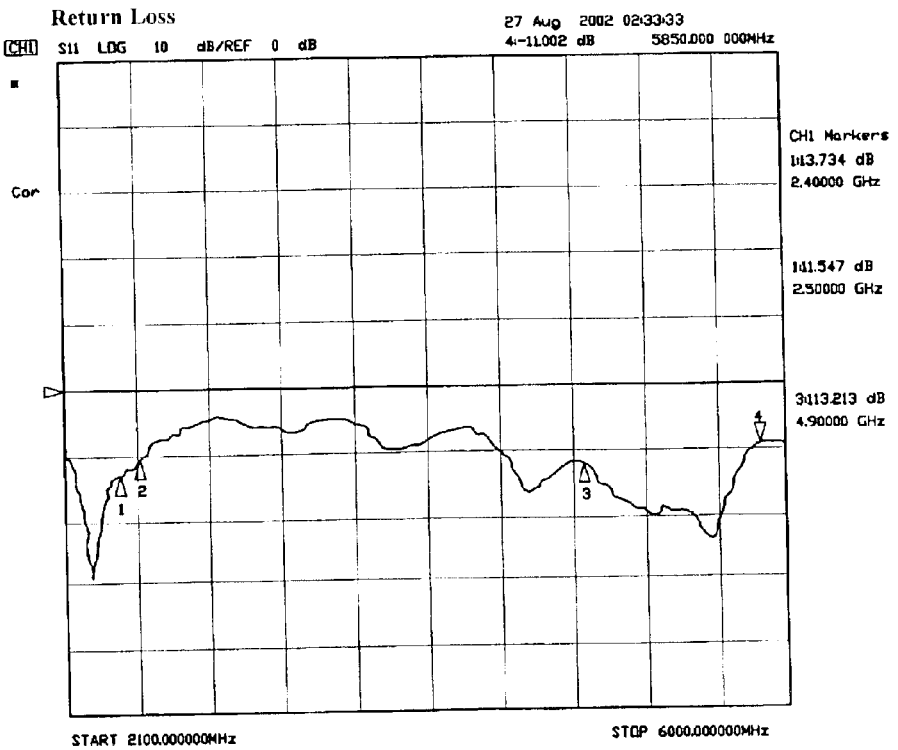
FIG. 5 shows the Return Loss of the embodiment of this invention.

According to the plotted VSWR and Return Loss shown in FIGS. 4 and 5, the bandwidth is about 400 MHz near 2.4 GHz and about 1300 MHz near 5.0 GHz, namely, the effective bandwidth of this invention is broadened to reach as wide as 25% of the high or low frequency band to work as a dual-frequency broadband antenna with a significant effect of signal radiation and reception.

Figure 6:
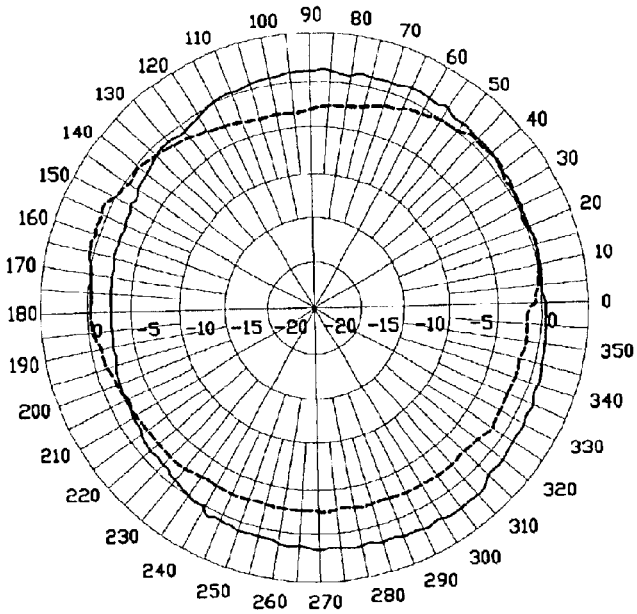
FIG. 6 shows the radiation field of the embodiment of this invention in H-Plane.
Figure 7:
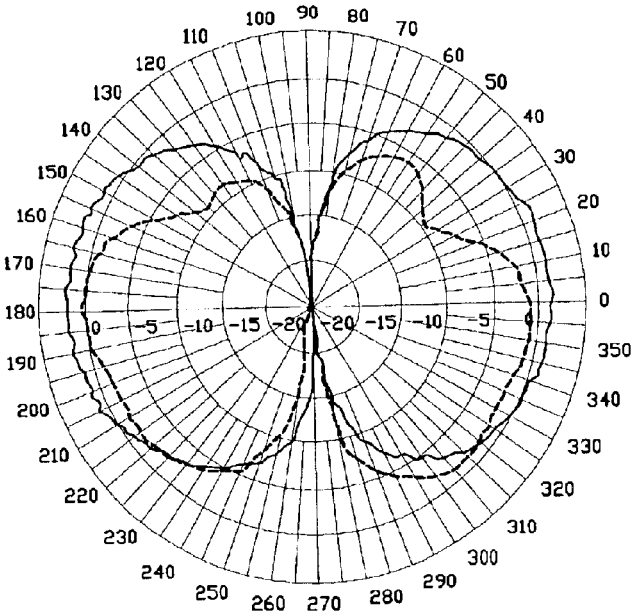
FIG. 7 shows the radiation field of the embodiment of this invention in E-Plane.

As indicated in FIGS. 6 and 7, the radiation field of this invention in H-Plane and E-Plane reveals an excellent radiation effect and a high gain thereof.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A dual-frequency broadband antenna comprising mainly a dipole antenna set and an inductive shield, in which:

a positive and a negative pole of the antenna are substantially two cup-like tubular hollow poles having a self-same length about ¼λ of a low-frequency band and are spaced out from a distance apart equal to ¼λ of a high frequency band; and the inductive shield which is substantially a tube having an open end is made of an insulating material for covering said dipole antenna set;

whereby the tubular hollow poles of said dipole antenna set is supposed to generate resonance vibration at a low-frequency band to thereby create resonance vibration at a high-frequency band and achieve a dual-frequency radiation and reception effect as well as an enlargement of effective bandwidth of high/low frequency bands by the associative inductive shield.

2. The dual-frequency broadband antenna according to claim 1, in which two close ends of those tubular hollow poles are directed inwardly while the open ends outwardly; a coaxial cable penetrates through one of the tubular hollow poles, and a conductive woven layer of the coaxial cable is connected to the close end of said tubular pole to serve for a negative pole (−) of low-frequency band, meanwhile, the core of said coaxial cable is isolated from the negative pole (−) and extended to connect with the close end of the other tubular hollow pole instead, to serve for a positive pole (+) of low-frequency band, in which the length of the extension end is the same with the distance between those two tubular hollow poles.

3. The dual-frequency broadband antenna according to claim 1, in which those two tubular hollow poles are substantially two copper tubes.

4. The dual-frequency broadband antenna according to claim 1, in which the insulating material adopted for the inductive shield is plastics.

* * * * *